US007166016B1

(12) United States Patent
Chen

(10) Patent No.: US 7,166,016 B1
(45) Date of Patent: Jan. 23, 2007

(54) SIX HEADED CAROUSEL

(75) Inventor: Hung Chih Chen, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/437,765

(22) Filed: May 18, 2006

(51) Int. Cl.
*B24B 7/00* (2006.01)

(52) U.S. Cl. ..... 451/11; 451/67; 451/283; 451/339

(58) Field of Classification Search ..... 451/11, 451/283, 285, 286, 287, 288, 289, 339, 65, 451/67, 914; 156/345.12
See application file for complete search history.

(56) References Cited

U.S. PATENT DOCUMENTS 4,141,180 A 2/1979 Gill, Jr. et al.
5,804,507 A 9/1998 Perlov et al.
5,993,302 A 11/1999 Chen et al.
6,156,124 A 12/2000 Tobin
6,159,079 A 12/2000 Zuniga et al.
6,183,354 B1 2/2001 Zuniga et al.
6,361,422 B1 * 3/2002 Ettinger et al. ..... 451/339
6,629,883 B1 10/2003 Katsuoka et al.
6,705,932 B1 3/2004 Zuniga et al.
6,951,597 B1 10/2005 Korovin
6,969,305 B1 11/2005 Kimura et al.
2002/0146312 A1 * 10/2002 Chokshi et al. ..... 414/803
2002/0177386 A1 11/2002 Smith
2004/0020789 A1 2/2004 Hu et al.
2004/0023495 A1 2/2004 Butterfield et al.
2004/0023610 A1 2/2004 Hu et al.
2004/0127142 A1 7/2004 Olgado
2005/0000801 A1 1/2005 Wang et al.
2005/0037698 A1 2/2005 Zuniga et al.
2005/0142993 A1 6/2005 Chen et al.
2005/0176349 A1 8/2005 Yilmaz et al.
2005/0211377 A1 9/2005 Chen et al.
2006/0035583 A1 2/2006 Kalenian et al.
2006/0105680 A1 * 5/2006 Jeong ..... 451/11

* cited by examiner

*Primary Examiner*—Jacob K. Ackun, Jr.
(74) *Attorney, Agent, or Firm*—Patterson and Sheridan

(57) ABSTRACT

The present invention relates to an apparatus and method for polishing semiconductor substrates with improved throughput and reduced foot print. One embodiment of the present invention provides an apparatus for polishing a substrate. The apparatus comprises a base, four polishing stations disposed on the base, two load cups disposed on the base and a carousel supported by the base. The carousel comprises six substrate heads and is rotatable about a carousel axis. Each of the six substrate heads is configured to align with any one of the four polishing stations and the two load cups.

20 Claims, 13 Drawing Sheets

SIX HEADED CAROUSEL

BACKGROUND OF THE INVENTION

1. Field of the Invention

Embodiments of the invention generally relate to an apparatus and method for polishing or planarization of semiconductor substrates.

2. Description of the Related Art

Sub-micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features. Reliable formation of these interconnect features is very important to the success of ULSI and to the continued effort to increase circuit density and quality on individual substrates and die.

In the fabrication of integrated circuits and other electronic devices, multiple layers of conductive, semiconductive, and dielectric materials are deposited on or removed from a surface of a substrate. Thin layers of conductive, semiconductive, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electro-chemical plating (ECP).

As layers of materials are sequentially deposited and removed, the uppermost surface of the substrate may become non-planar across its surface and require planarization. An example of non-planar process is the deposition of copper films with the ECP process in which the copper topography simply follows the already existing non-planar topography of the wafer surface, especially for lines wider than 10 microns. Planarizing a surface, or "polishing" a surface, is a process where material is removed from the surface of the substrate to form a generally even, planar surface. Planarization is useful in removing undesired surface topography and surface defects, such as rough surfaces, agglomerated materials, crystal lattice damage, scratches, and contaminated layers or materials. Planarization is also useful in forming features on a substrate by removing excess deposited material used to fill the features and to provide an even surface for subsequent levels of metallization and processing.

Planarization is generally performed using Chemical Mechanical Polishing (CMP) and/or Electro-Chemical Mechanical Deposition (ECMP). A planarization method typically requires that the substrate be mounted in a wafer head, with the surface of the substrate to be polished exposed. The substrate supported by the head is then placed against a rotating polishing pad. The head holding the substrate may also rotate, to provide additional motion between the substrate and the polishing pad surface. Further, a polishing slurry (typically including an abrasive and at least one chemically reactive agent therein, which are selected to enhance the polishing of the topmost film layer of the substrate) is supplied to the pad to provide an abrasive chemical solution at the interface between the pad and the substrate.

The combination of polishing pad characteristics, the specific slurry mixture, and other polishing parameters can provide specific polishing characteristics. Thus, for any material being polished, the pad and slurry combination is theoretically capable of providing a specified finish and flatness on the polished surface. It must be understood that additional polishing parameters, including the relative speed between the substrate and the pad and the force pressing the substrate against the pad, affect the polishing rate, finish, and flatness. Therefore, for a given material whose desired finish is known, an optimal pad and slurry combination may be selected. Typically, the actual polishing pad and slurry combination selected for a given material is based on a trade off between the polishing rate, which determines in large part the throughput of wafers through the apparatus, and the need to provide a particular desired finish and flatness on the surface of the substrate.

Because the flatness and surface finish of the polished layer is dictated by other processing conditions in subsequent fabrication steps, throughput insofar as it involves polishing rate must often be sacrificed in this trade off. Nonetheless, high throughput is essential in the commercial market since the cost of the polishing equipment must be amortized over the number of wafers being produced. Of course, high throughput must be balanced against the cost and complexity of the machinery being used. Similarly, floor space and operator time required for the operation and maintenance of the polishing equipment incur costs that must be included in the sale price. For all these reasons, a polishing apparatus is needed which has high throughput, is relatively simple and inexpensive, occupies little-floor space, and requires minimal operator control and maintenance.

Multiple polishing steps have been used for polishing the substrate to thereby allow improved polishing rate and finish with multiple pad or slurry combinations, hence increasing throughput.

One method provides a main polishing surface and a fine polishing surface in a polishing apparatus. A single polishing head, controlled by a single positioning apparatus, moves a single substrate between the different polishing stations on the apparatus. However, at least one polishing surface is idle at any given time.

Another method provides multiple polishing pads, each pad corresponding to a polishing head, and a substrate handling device moving the substrate being processed among the polishing pads and heads. However, multiple loading and unloading of substrates limits the throughput and also increases the possibility of particle contamination.

Another method of increasing throughput uses a wafer head having a plurality of substrate loading stations therein to simultaneously load a plurality of substrates against a single polishing pad to enable simultaneous polishing of the substrates on the single polishing pad. Although this method would appear to provide substantial throughput increases over the single substrate style of wafer head, several factors militate against the use of such carrier arrangements for planarizing substrates, particularly after deposition layers have been formed thereon. First, the wafer head holding the wafer being polished is complex. To attempt to control the force loading each substrate against the pad, one approach floats the portion of the head holding the wafer. A floating wafer holder necessitates a substantial number of moving parts and pressure lines must be included in the rotating and moving geometry. Additionally, the ability to control the forces pressing each individual substrate against the pad is limited by the floating nature of such a wafer head assembly, and therefore is a compromise between individual control and ease of controlling the general polishing attributes of the multiple substrates. Finally, if any one substrate develops a problem, such as if a substrate cracks, a broken piece of the substrate may come loose and destroy all of the other substrates being polished on the same pad.

Polishing throughput is yet further limited by the requirement that wafers be washed at the end of polishing and sometimes between stages of polishing. Although washing time has been limited in the past by simultaneously washing multiple wafer head, insofar as the washing requires additional machine time over that required for polishing, system throughput is adversely affected.

Therefore, there is a need for a polishing apparatus which enables optimization of polishing throughput.

SUMMARY OF THE INVENTION

The present invention provides methods and apparatus for polishing semiconductor substrates with improved throughput.

One embodiment provides an apparatus for polishing a semiconductor substrate. The apparatus comprises a base, four polishing stations disposed on the base, two load cups disposed on the base, and a carousel supported by the base, wherein the carousel comprises six substrate heads and is rotatable about a carousel axis, and each of the six substrate heads is configured to align with any one of the four polishing stations and the two load cups.

Another embodiment of the present invention provides a polishing system. The polishing system comprises a base, four polishing stations disposed on the base, two load cups disposed on the base, and a carousel supported by the base and rotatable about a carousel axis, the carousel comprising a carousel base, and six substrate heads mounted on the carousel base at equal angular intervals about the axis, wherein each of the substrate heads is rotatable about its own center and radially movable relative to the carousel axis, and each of the substrate heads is configured to support and transfer a substrate among the polishing stations and load cups.

Yet another embodiment of the present invention provides a method for polishing a substrate. The method comprises providing a polishing system having at least six substrate heads mounted on a carousel, loading a first substrate on a first substrate head of the at least six substrate heads by aligning the first substrate head with a first load cup, aligning the first substrate head with a first polishing station, and polishing the first substrate in the first polishing station.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention provides methods and apparatus for polishing semiconductor substrates with improved throughput.

Figure 1:
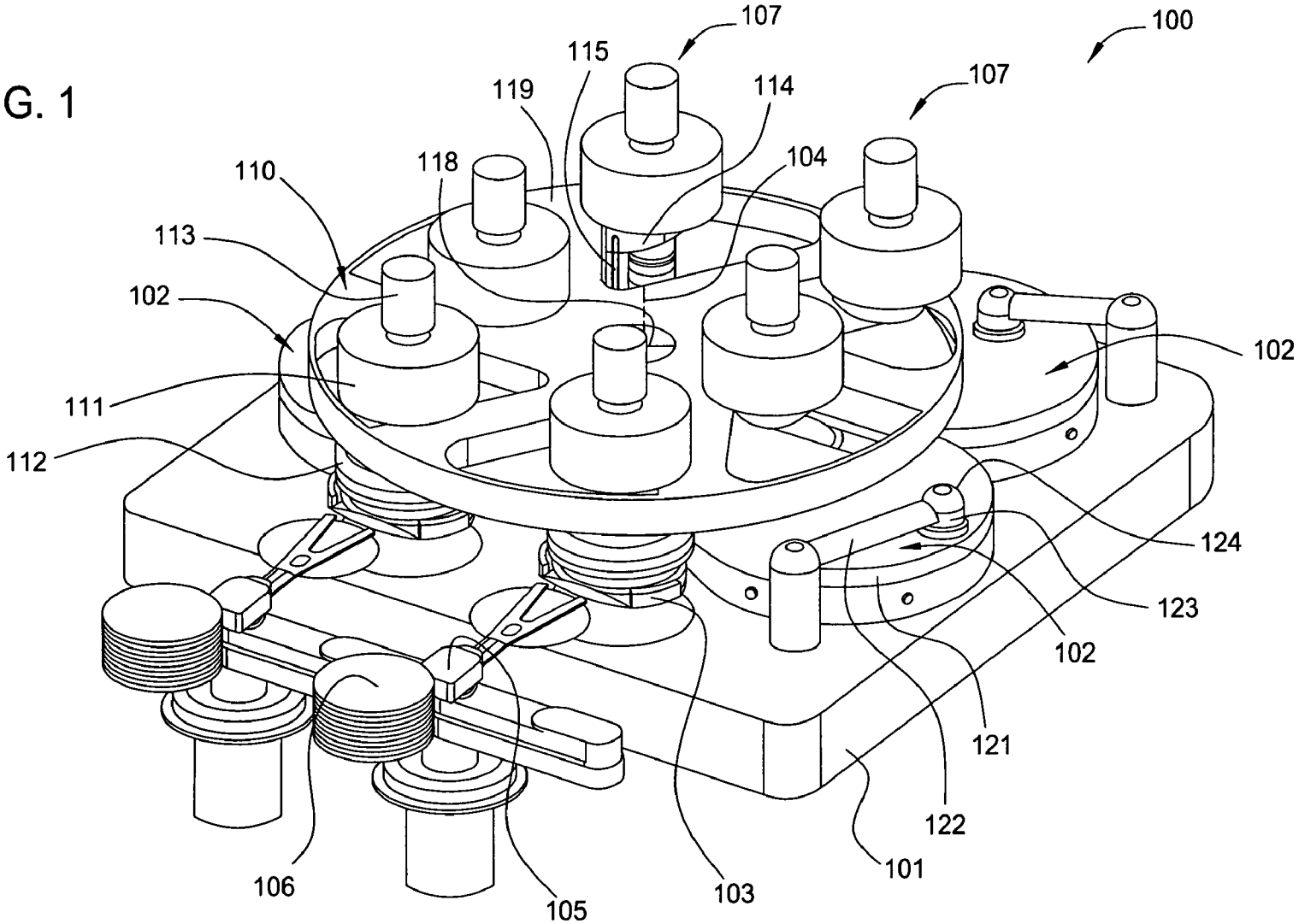
FIG. 1 illustrates a perspective view of a polishing system in accordance with one embodiment of the present invention.

FIG. 1 illustrates a perspective view of a polishing system 100 in accordance with one embodiment of the present invention.

The polishing system 100 is configured to conduct multiple step polishing and/or batch polishing. The polishing system 100 generally comprises a base 101 that support multiple polishing stations 102, one or more load cups 103, and a carousel 110. In one embodiment, four polishing stations 102 and two load cups 103 are generally disposed on the base 101. The carousel 110 comprises six head systems 107 configured to receive, transfer and process substrates. The polishing stations 102 and the load cups 103 are disposed in a circular manner with the load cups 103 next to each other. One or more robot 105 configured to transfer substrates between the load cups 103 and cassettes 106 may be positioned approximate the load cups 103.

Each polishing station 102 includes a rotatable platen 121 on which a polishing pad 124 is placed. Each polishing station 102 further includes a conditioner head 123 adapted on a rotatable arm 122. A detailed description for the rotatable platen 121 and the polishing pad 124 may be found in co-pending U.S. patent application Ser. No. 10/880,752, filed on Jun. 30, 2004, entitled "Method and Apparatus for Electrochemical Mechanical Processing", which is herein incorporated as reference. A detailed description for the polishing pad 124 may be found in co-pending U.S. patent application Ser. No. 10/455,895, filed on Jun. 6, 2003, entitled "Conductive Polishing Article for Electrochemical Mechanical Polishing", which is herein incorporated as reference. Each of the polishing stations 102 may be configured to conduct chemical mechanical polishing (CMP), electrochemical mechanical polishing (ECMP) or buffing.

In one embodiment, the carousel 110 comprises six head systems 107. Each of the head systems 107 is configured to receive one substrate, transfer the substrate among the polishing stations 102 and the load cups 103, and polish the substrate by pressing the substrate against any one of the polishing pads 124 on the polishing stations 102. In one embodiment, the carousel 110 is supported by a center post 118 on the base 101. The carousel 110 is rotatable on the center post 118 about a carousel axis 104 by a motor assembly (not shown) located within the base 101. In one embodiment, the motor assembly may comprise a servo motor.

In one embodiment, the six head systems 107 are identical and mounted on a carousel base plate 119 at equal angular intervals about the carousel axis 104. The center post 118 supports the carousel base plate 119 and allows the motor assembly to rotate the carousel base plate 119.

Each head system 107 comprises a substrate head 112 which is rotatable about its own axis by a head-rotation motor 111 connected to the substrate head 112 by a shaft. The substrate heads 112 can rotate independently driven by the respective head-rotation motor 111. Each head system 107 is independently movable along a slot 116 formed radially on the carousel base plate 119. In one embodiment, for each head system 107, the linear movement along the respectively slot 116 is realized through a slide 114 mounted around the shaft between the head-rotation motor 111 and the substrate head 112. In one embodiment, each slide 114 is connected to a lead screw 115 driven by a sweeping motor 117 (shown in FIG. 2) disposed near the center post 118. In one aspect, the linear movement along the slots 116 may be performed in an oscillating manner to provide the respective substrate head 112 a sweeping motion relative to the polishing station 102 during polishing. In another aspect, the linear movement along the slots 116 enables each head system 107 to get aligned with the polishing stations 102 and load cups 103 which are not centered in a perfect hexagon to reduce the foot print (will be further described in FIG. 2).

During process, four of the six head systems 107 are positioned above a respective polishing station 102 in a nonconcentric manner. The substrate retained on each substrate head 112 is lowered using substrate lowering/raising mechanism within the head system 107. Polishing is conducted via a relative motion produced between the substrate retained therein and the platen 121 of the respective polishing station 102. In one embodiment, the relative motion may be a result of a rotation of the platen 121, a rotation of the substrate head 112 and a sweeping motion of the substrate head 112. A suitable head system may be a Titan® polishing head available from Applied Materials, Inc. located in Santa Clara, Calif. A detailed description of the substrate head 112 may be found in U.S. Pat. No. 6,183,354, entitled "Carrier Head with a Flexible Membrane for a Chemical Mechanical Polishing", and co-pending U.S. patent application Ser. No. 11/054,128 filed on Feb. 8, 2004, entitled "Multi-chamber Carrier Head with a Flexible Membrane", which are herein incorporated as reference.

The load cups 103 are positioned on the base 101 such that when four of the six head systems 107 are in polishing position above a respective polishing station 102, the other two head systems 107 may be aligned to the two load cups 103 respectively. Each load cup 103 is configured to receive/pass a substrate from/to the robot 105, pass/receive the substrate to/from each of the head systems 107. In one embodiment, the load cups 103 may be also adapted to be a wash station for a substrate to be cleaned therein. A detailed description of a load cup may be found in co-pending U.S. patent application Ser. No. 10/988,647, filed on Nov. 15, 2004, entitled "Load Cup for Chemical Mechanical Polishing", which is herein incorporated as reference.

Figure 2:
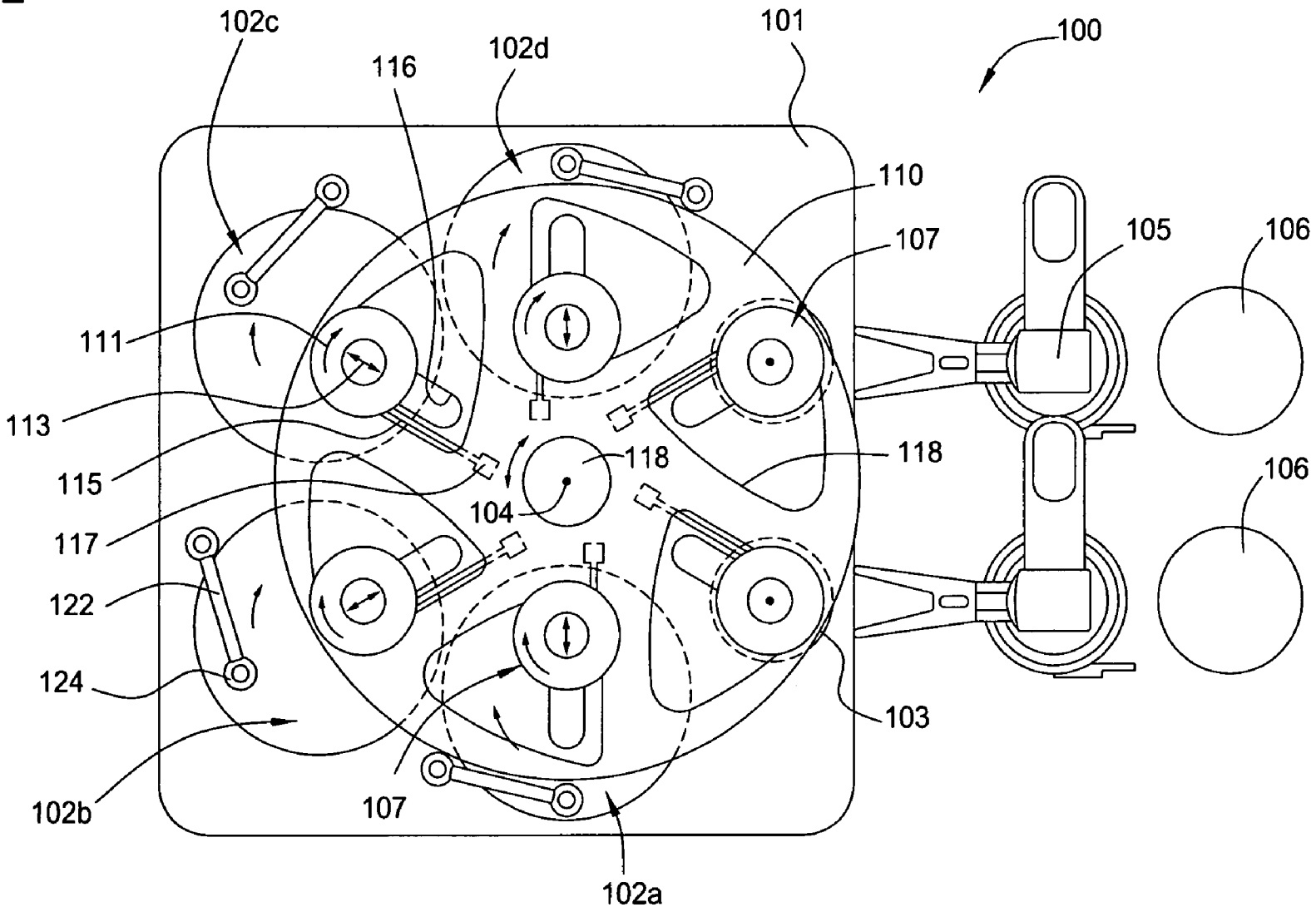
FIG. 2 illustrates a top view of the polishing system shown in FIG. 1.

FIG. 2 illustrates a top view of the polishing system 100 of in FIG. 1 in a polishing position. In one embodiment, foot print of the polishing system 100 may be minimized by using variable working positions for each head system 107 among the polishing stations 102 and the load cups 103. In one embodiment, the variation of working positions for each head system 107 may be realized by sliding radially along the corresponding slot 116. As shown in FIG. 2, when the head system 107 is above the polishing stations 102*a* and 102*d*, the head system 107 works near the carousel axis 104 by sliding radially inward along the corresponding slot 116. On the other hand, when the head system 107 is above the polishing stations 102*b* and 102*c*, the head system 107 works far away from the carousel axis 104 by sliding radially outward along the corresponding slot 116. In the configuration, center of the polishing stations 102*a–d* and the load cups 103 are positioned in a non symmetric hexagon (not a perfect hexagon) for the six headed carousel 110. The polishing stations 102*a* and 102*d* are positioned relatively inward to minimize the foot print, therefore, save space in the cleanroom and improve cost of ownership. In one embodiment, the polishing stations 102 may have a diameter of about 762 mm (30 inches) for processing 300 mm substrates.

As discussed in the background, polishing characteristics are determined by combination of polishing pad characteristics, specific slurry mixtures, and other polishing parameters. Each of the polishing stations 102 may be configured to performed different polishing effect according to the requirement. In one embodiment, the polishing stations 102 may have the same setting to performed a one step batch processing. In another embodiment, the polishing stations 102 may be set in a sequence that conducts four different polishing steps, e.g. bulk material removal, fine polishing, barrier layer polishing, and buffing. In another embodiment, the polishing stations 102 may be configured to perform a two step polishing wherein two polishing stations may perform the same polishing steps.

During process, a substrate to be processed is generally transferred from the cassette 106 to one of the load cups 103 by one of the robots 105. After the robot 105 drops off the substrate on the load cup 103, the carousel 110 may rotate so that a particular head system 107 is right above the load cup 103 with the substrate to be processed if the particular head system 107 is not already in position. In one embodiment, the particular head system 107 may need to slide along the corresponding slot 116 to be in position for picking up the substrate on the load cup 103. In another embodiment, the load cup 103 may be movable to complete the alignment between the head system 107 and the load cup 103. A detailed method of alignment may be found in co-pending United States Patent Application entitled "Rotational Alignment Mechanism for New Load Cup", 60/810,350, which is herein incorporated as reference. When in position, the head system 107 generally lowers the head 112 to load the substrate on the head 112.

After the substrate to be processed has been loaded on the head 112, the head 112 raised up. When all six head systems 107 of the carousel 110 is ready, e.g., polishing is finished, loading/uploading is completed, the carousel 110 may rotate by an increment of 60° to position the head system 107 with the substrate to be processed in one of the polishing stations 102. The head system 107 may then slide along the slot 116 to a working position corresponding to the polishing station 102 and lower the head 112 to apply a pressure between the substrate to be processed and the polishing pad 124 of the polishing station 102 and start a polishing process. During polishing, the polishing station 102 and the head 112 both rotates about their center axis. Because the center axis of the polishing station 102 and the head 112 are offset, the rotations of the polishing station 102 and the head 112 generate a relative motion between the polishing station 102 and the head 112, hence, generating a relative motion between the polishing pad 124 and the substrate to be processed. In one embodiment, the rotations of the polishing station 102 and the head 112 are of the same direction, for example, both clock wise or both counter clock wise. In another embodiment, the head system 107 also performs a sweeping motion by oscillating about the polishing position driven by the sweeping motor 117. The sweeping motion provides a uniform polishing rate across the substrate to be processed.

For a one step polishing, the substrate may be rotate in 60° increments in one or more steps to the load cups 103 to be unloaded after the polishing is completed. In one embodiment, both of the two load cups 103 are configured to load and unload a substrate. In another embodiment, one of the two load cups 103 is configured to load unprocessed substrates, while the other load cup 103 is configured to unload processed substrates. To unload the substrate, the head system 107 first align with the load cup 103, then lower the head 112 down and drop off the substrate on the load cup 103, and raise the head 112. The substrate may then be picked up by the robot 105 and transferred to the cassette 106.

For a multiple step processing, the substrate may be rotated and aligned with the polishing station 102 where a sequential polishing step is to be performed. Again, the head 112 will be lowered down to perform a polishing step and raised up after the polishing step is done. The substrate is then rotated in sequence to the polishing stations 102 where the remaining polishing steps are to be performed. When all the polishing steps are completed, the carousel 110 will rotate to align the head system 107 having the substrate with the load cup 103 where unloading is to be performed.

FIGS. 3A–F illustrate an exemplary sequence of a two step polishing process using the polishing system 100 of FIG. 1. For clarity and simplicity, the load cups 103 of FIG. 1 are marked as L1 and L2 respectively, the polishing stations 102 are marked as P1, P2, P3 and P4 respectively, and the head systems 107 are marked as H1, H2, H3, H4, H5 and H6 respectively. Wn represents the nth substrate.

In one embodiment, the polishing stations P1 and P2 are configured to perform step 1 of the two step polishing process and the polishing stations P3 and P4 are configured to perform step 2 of the two step polishing. Both load cups L1 and L2 are configured to load unprocessed substrates and unload processed substrates. The carousel 110 is illustrated to rotate clockwise. However, the carousel 110 may also rotate counter clockwise to achieve the same result with proper variations in the sequencing and step arrangement.

Figure 3A:
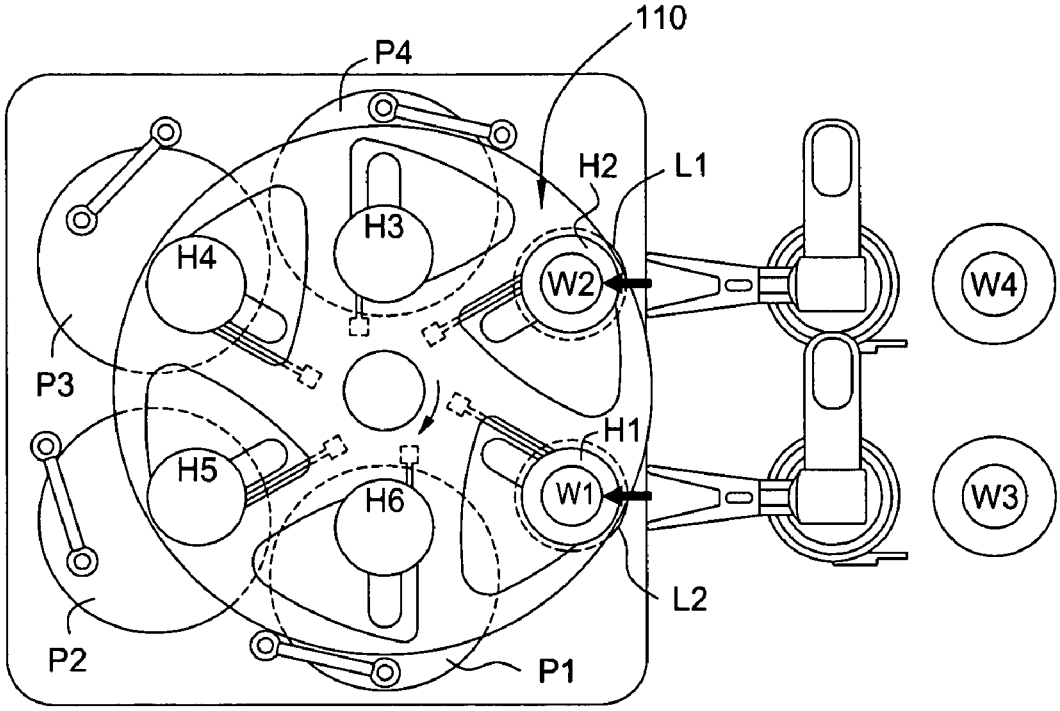
FIGS. 3A–3F illustrate an exemplary sequence of a polishing process using the polishing system of FIG. 1.

FIG. 3A illustrates that the polishing system 100 in its initial status, wherein the polishing heads H3–H6 are empty, the polishing stations P1–P4 are idle. Unprocessed substrates W1 and W2 are loaded onto the head systems H1 and H2 respectively.

Figure 3B:
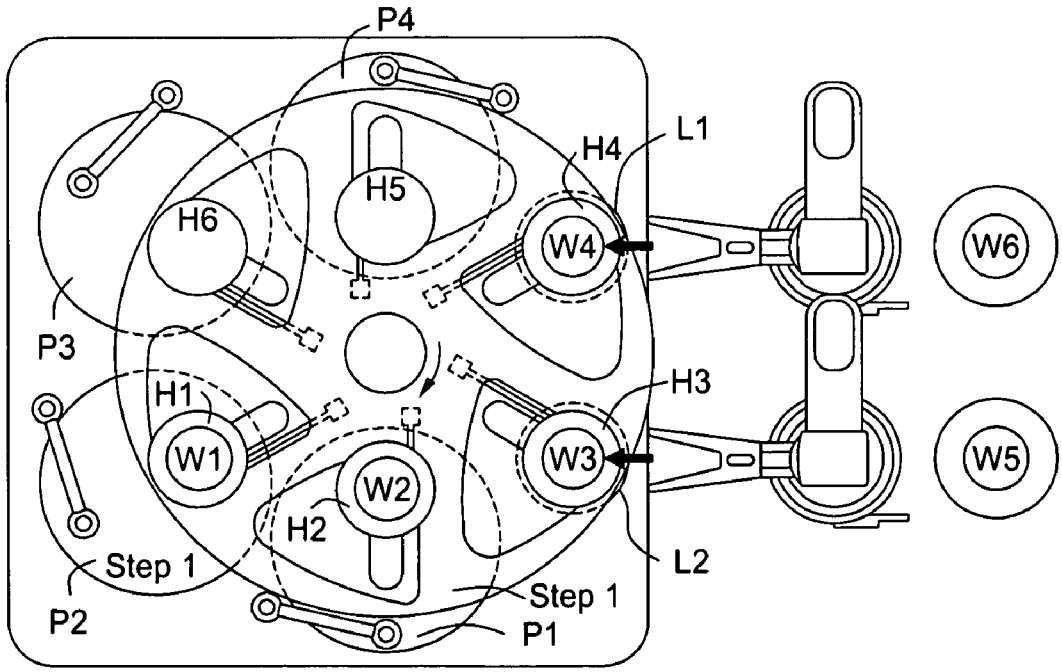

FIG. 3B illustrates that the carousel 110 rotates 120° clockwise so that the head systems H1 and H2 may be aligned with the polishing stations P2 and P1 respectively. Polishing step 1 is conducted at the polishing station P2 and P1 simultaneously to substrates W1 and W2 respectively. While polishing step 1 is in process, the head systems H3 and H4 are aligned with the load cups L1 and L2 respectively, and unprocessed substrates W3 and W4 are loaded onto the head systems H3 and H4 respectively. The carousel 110 remains in this position until the polishing process is completed in the polishing station P1 and P2.

Figure 3C:
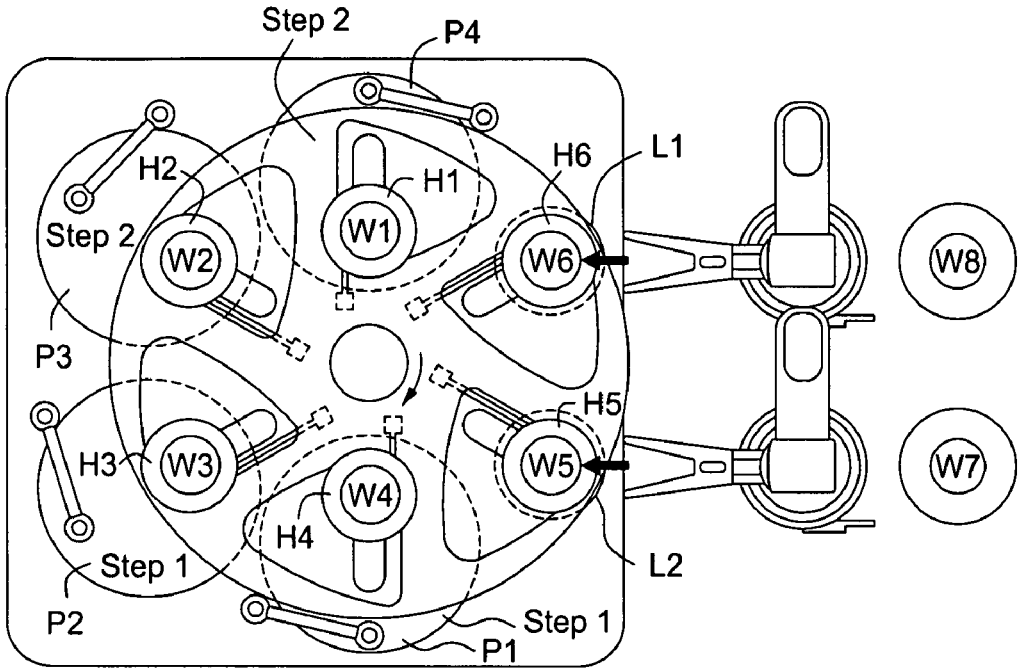

Upon polishing step 1 is completed in the polishing stations P2 and P1 to substrates W1 and W2, the carousel 110 rotates 120° clockwise again so that the head systems H1, H2, H3 and H4 may be aligned with the polishing stations P4, P3, P2 and P1 respectively, as shown in FIG. 3C. When the head systems and the polishing stations are aligned, processing may be conducted in all four polishing stations P1–4 simultaneously, wherein polishing step 1 is performed in the polishing stations P2 and P1 to substrate W3 and W4 respectively, and polishing step 2 is performed in the polishing stations P4 and P3 to substrate W1 and W2 respectively. While polishing process is in process in the polishing stations P1–4, the head system H5 and H6 are aligned with the load cups L1 and L2 respectively and substrates W5 and W6 are loaded on the head system H5 and H6 respectively. Generally, the carousel 110 remains in this position until polishing steps are completed in all the polishing stations P1–4.

Figure 3D:
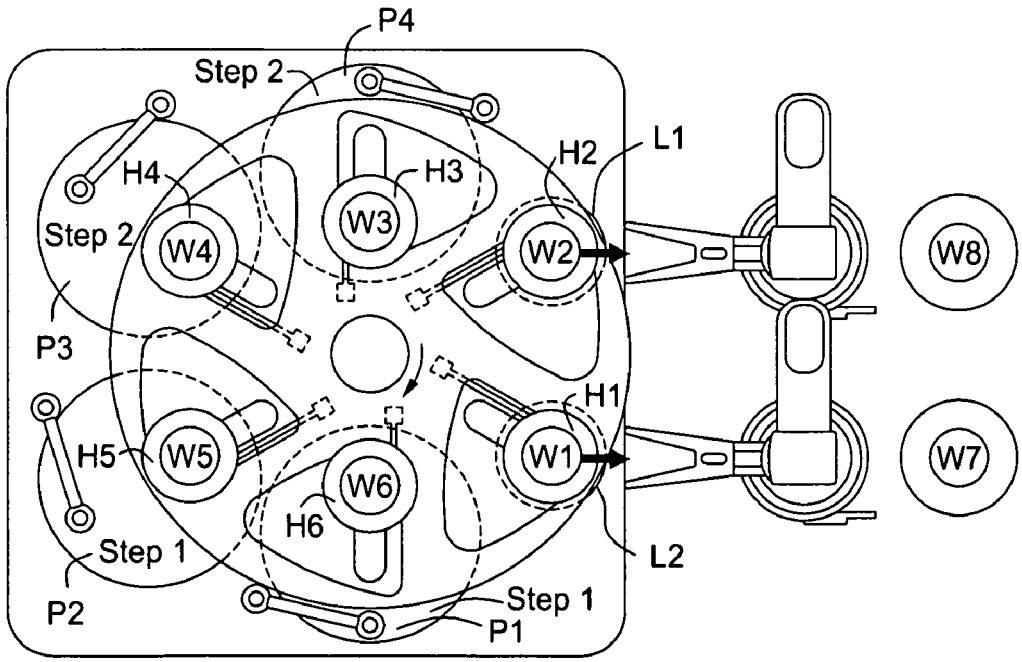
Figure 3E:
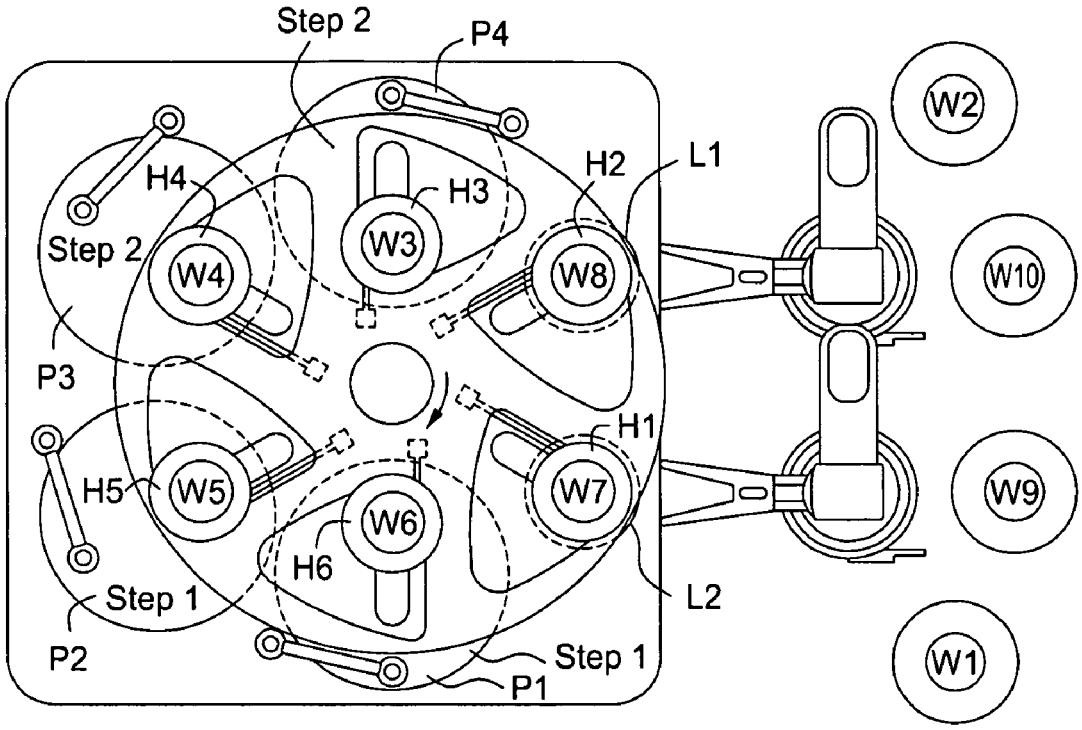

FIG. 3D illustrates that the carousel 110 has rotates another 120° clockwise from the position shown in FIG. 3C. The head systems H3, H4, H5 and H6 are aligned with the polishing stations P4, P3, P2 and P1 respectively. Polishing process is conducted in all four polishing stations P1–4 simultaneously, wherein polishing step 1 is performed in the polishing stations P2 and P1 to substrate W5 and W6 respectively, and polishing step 2 is performed in the polishing stations P4 and P3 to substrate W3 and W4 respectively. While polishing process is in process in the polishing stations P1–4, the head system H1 and H2 are aligned with the load cups L1 and L2 respectively. Substrates W1 and W2 are then unloaded from the head system H1 and H2 to the load cups L1 and L2. Substrates W1–2 are then unloaded from the load cups L1–2 to cassettes and unprocessed substrates W7 and W8 are loaded to the head system H1 and H2 respectively, as shown in FIG. 3E. Because loading and unloading process is generally much shorter than the a polishing step, the unloading of substrates W1–2 and loading of the substrate W7–8 may be finished while the polishing process is on going in the polishing stations P1–4. Generally, the carousel 110 remains in this position, until the longest step among polishing step 1 for substrates W5–6, polishing step 2 for substrates W3–4, and unloading of substrate W1–2 followed by loading of substrates W7–8, is completed. It should be noted that substrates W1–2 are shown to be disposed in separate cassettes as unprocessed substrates for clarity. In one embodiment, the processed substrates may be placed in the same cassettes they come from.

Figure 3F:
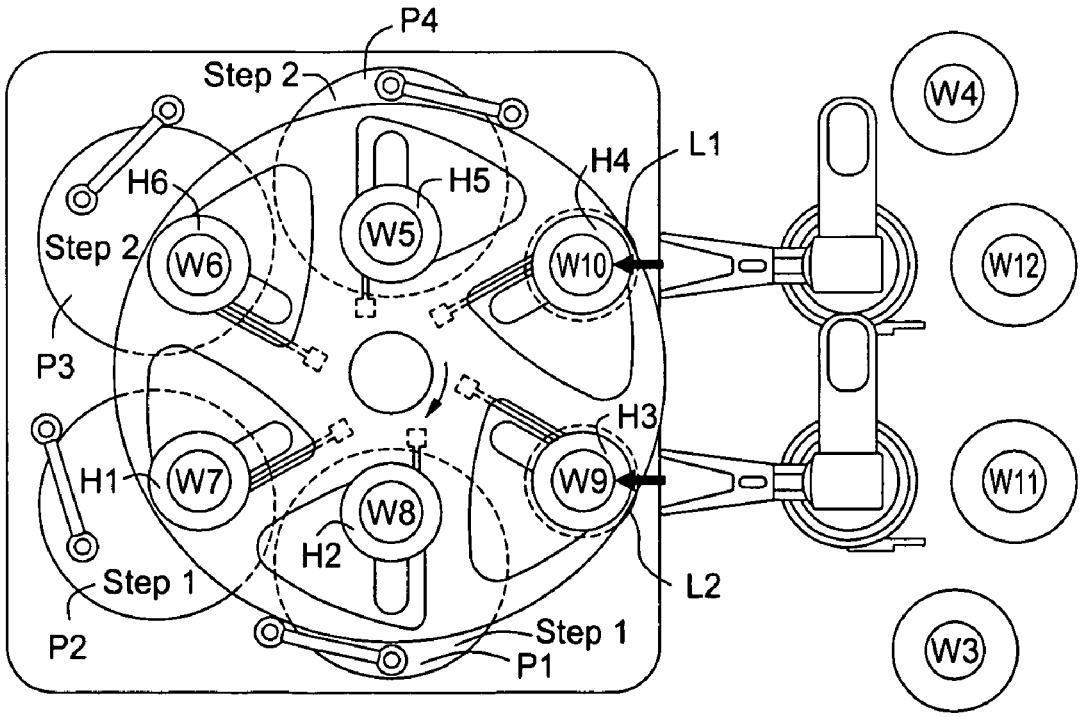

FIG. 3F illustrates that the carousel 110 rotates another 120° clockwise from the position shown in FIGS. 3D–E. In this position, polishing process is conducted in all four polishing stations P1–4 simultaneously, wherein polishing step 1 is performed in the polishing stations P2 and P1 to substrate W7 and W8 respectively, and polishing step 2 is performed in the polishing stations P4 and P3 to substrate W5 and W6 respectively. Substrates W3–4 are unloaded and new substrates W9–10 are loaded and waiting in queue to be processed. To this point, a two step processing sequence is established and the process of FIG. 3F may be repeated.

As shown in FIGS. 3D–E, the time to process two substrates for a two step polishing process equals the longest step among polishing step 1, polishing step 2 and unloading/loading. Therefore, the sequence shown in FIGS. 3A–F may produce up to 2× throughput for a two step processing compared to polishing systems with three polishing stations and one load cup.

FIGS. 4A–G illustrate an exemplary sequence of a four step polishing process using the polishing system 100 of FIG. 1.

In one embodiment, the polishing stations P1, P2, P3 and P4 are configured to perform step 1, step 2, step 3 and step 4 of the four step polishing process respectively. The load cup L1 is configured to load unprocessed substrates on the head systems H1–6, and the load cup 2 is configured to unload processed substrates from the head systems H1–6. The carousel 110 is illustrated to rotate clockwise. However, the carousel 110 may also rotate counter clockwise to achieve the same result with proper variations in the sequencing and step arrangement.

Figure 4A:
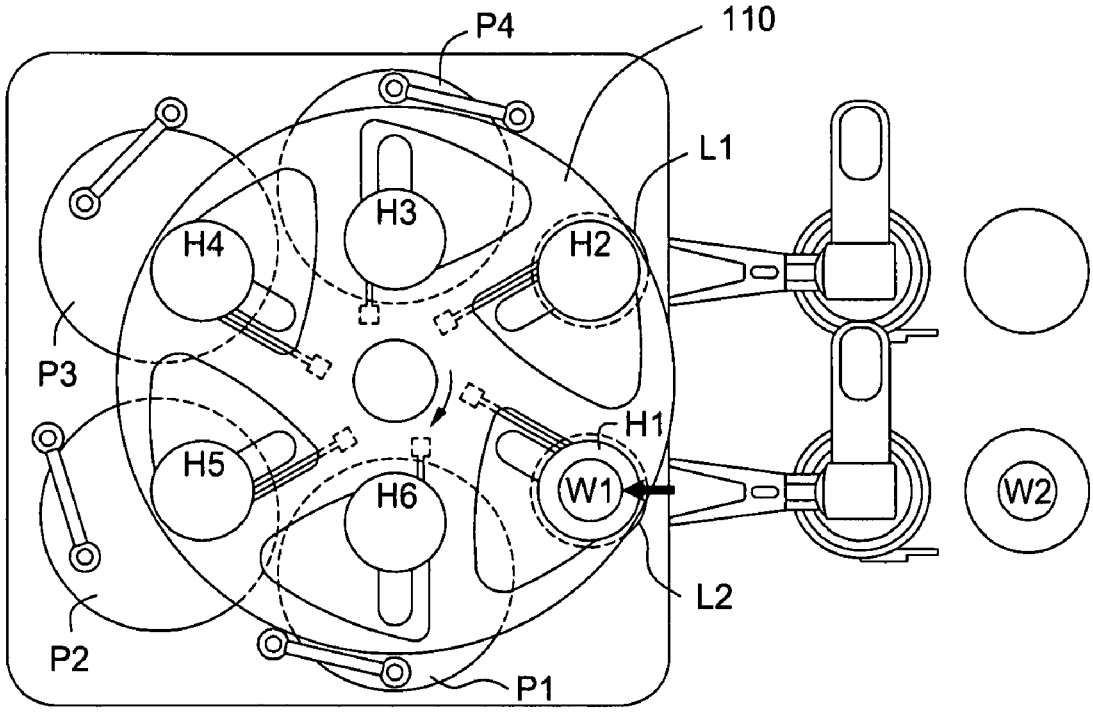
FIGS. 4A–G illustrate an exemplary sequence of a polishing process using the polishing system of FIG. 1.

FIG. 4A illustrates that the polishing system 100 in its initial status, wherein the polishing heads H2–H6 are empty, the polishing stations P1–P4 are idle. Unprocessed substrate W1 is loaded onto the head system H1 at the load cup L1.

Figure 4B:
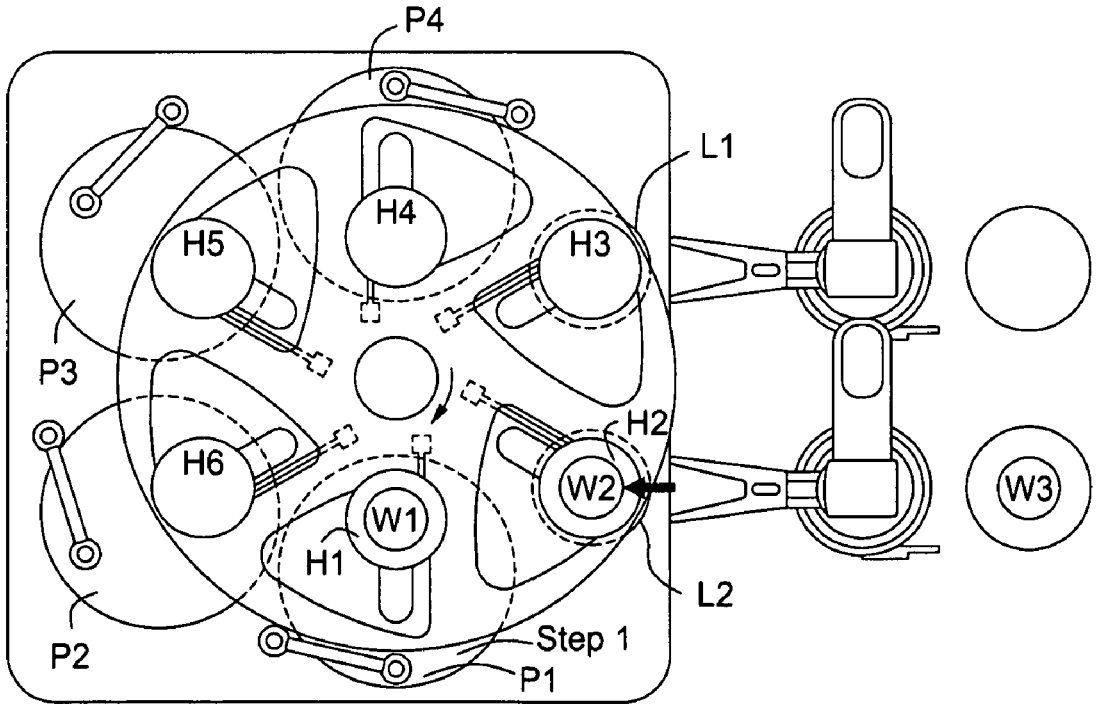

FIG. 4B illustrates that the carousel 110 rotates 60° clockwise so that the head system H1 may be aligned with the polishing station P1. Polishing step 1 may be then conducted at the polishing station P1 to substrate W1. While polishing step 1 is in process, the head system H2 is aligned with the load cup L1, and unprocessed substrate W2 is loaded onto the head system H2. The carousel 110 remains in this position until the polishing process is completed in the polishing station P1.

Figure 4C:
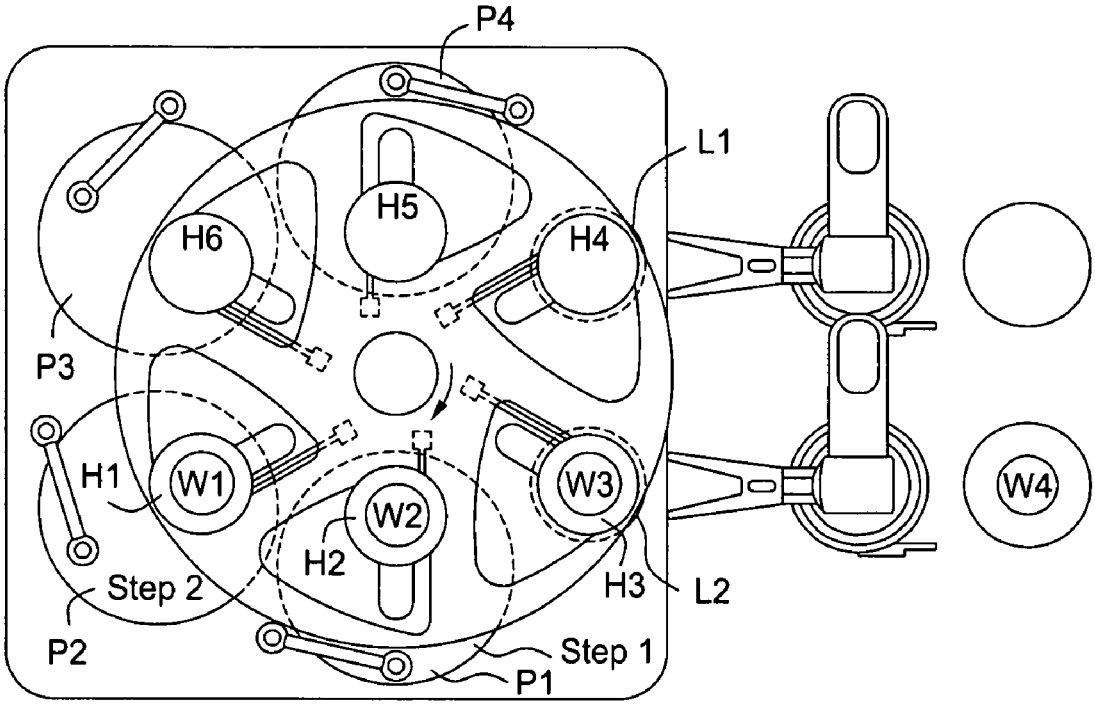

Upon polishing step 1 is completed in the polishing station P1 to substrate W1, the carousel 110 rotates another 60° clockwise again so that the head systems H1 and H2 may be aligned with the polishing stations P2 and P1 respectively, as shown in FIG. 4C. When the head systems and the polishing stations are aligned, processing may be conducted in the polishing stations P1–2 simultaneously, wherein polishing step 1 is performed in the polishing station P1 to substrate W2, and polishing step 2 is performed in the polishing station P2 to substrate W1. While polishing process is in process in the polishing stations P1–2, the head system H3 is aligned with the load cup L1 and substrate W3 is loaded on the head system H3. Generally, the carousel 110 remains in this position until polishing steps are completed in the both polishing stations P1–2.

Figure 4D:
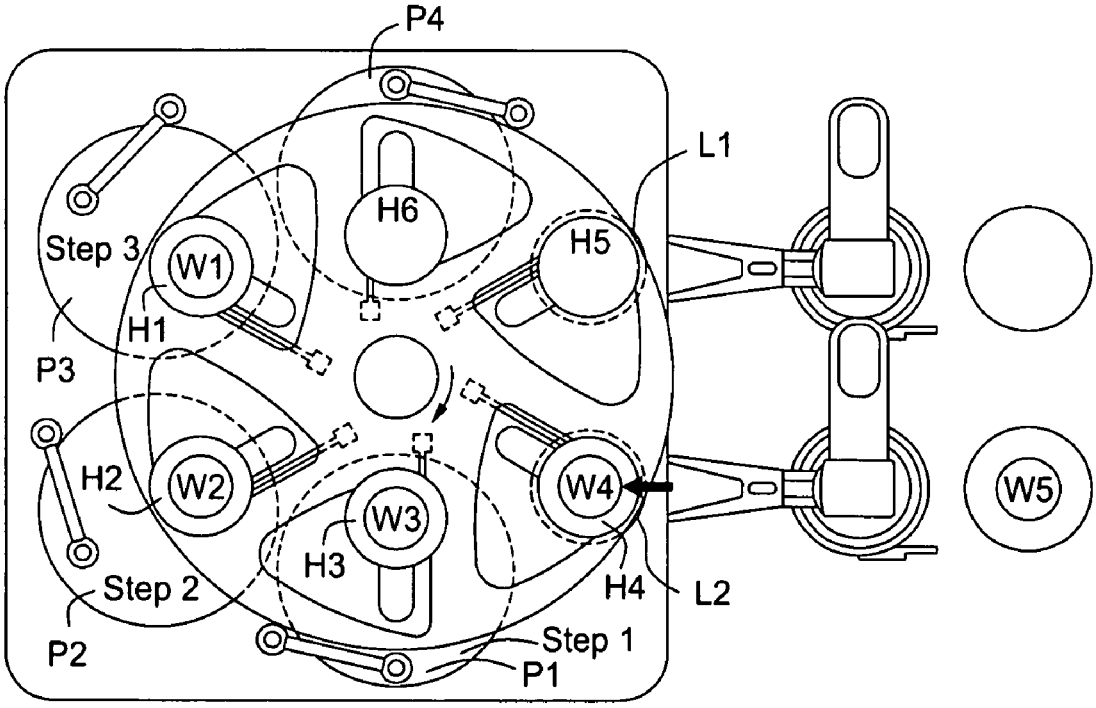

FIG. 4D illustrates that, after completing the polishing process shown in FIG. 4C, the carousel 110 rotates another 60° clockwise so that the head systems H1, H2 and H3 may be aligned with the polishing stations P3, P2 and P1 respectively. When the head systems and the polishing stations are aligned, processing may be conducted in the polishing stations P1–3 simultaneously, wherein polishing step 1 is performed in the polishing station P1 to substrate W3, polishing step 2 is performed in the polishing station P2 to substrate W2, and polishing step 3 is performed in the polishing station P3 to substrate W1. While polishing process is in process in the polishing stations P1–3, the head system H4 is aligned with the load cup L1 and unprocessed substrate W4 is loaded on the head system H4. Generally, the carousel 110 remains in this position until polishing steps are completed in the all the polishing stations P1–3.

Figure 4E:
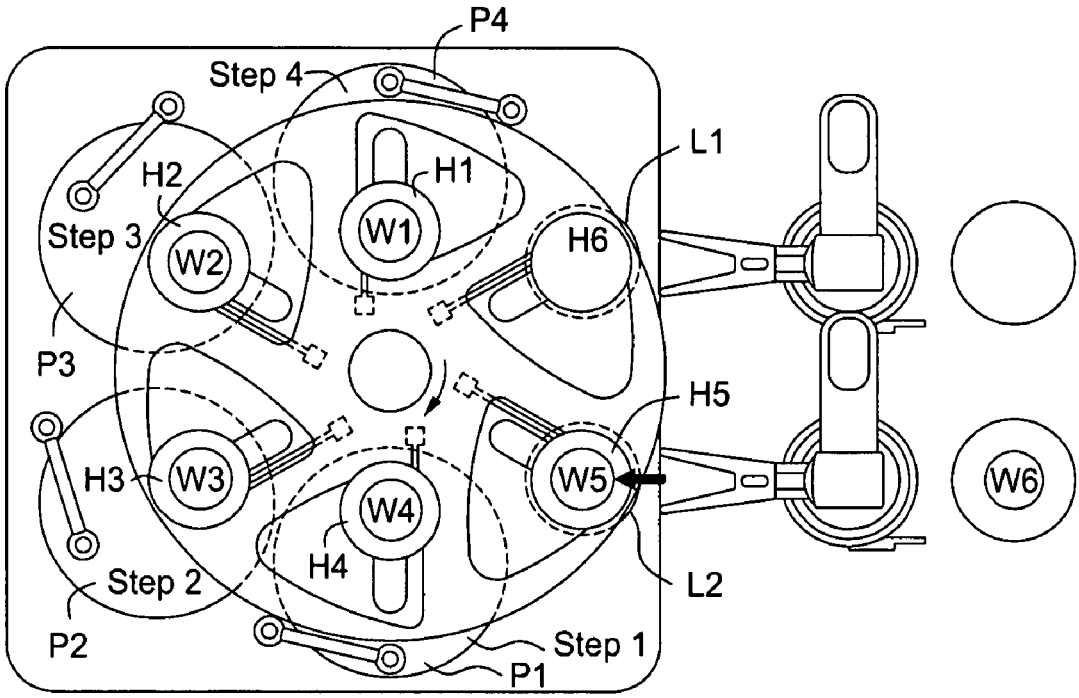

FIG. 4E illustrates that, after completing the polishing process shown in FIG. 4D, the carousel 110 rotates another 60° clockwise so that the head systems H1, H2, H3, and H4 may be aligned with the polishing stations P4, P3, P2 and P1 respectively. When the head systems and the polishing stations are aligned, processing may be conducted in the polishing stations P1–4 simultaneously, wherein polishing step 1 is performed in the polishing station P1 to substrate W4, polishing step 2 is performed in the polishing station P2 to substrate W3, polishing step 3 is performed in the polishing station P3 to substrate W2, and polishing step 4 is performed in the polishing station P4 to substrate W1. While polishing process is in process in the polishing stations P1–4, the head system H5 is aligned with the load cup L1 and substrate W5 is loaded on the head system H5. Generally, the carousel 110 remains in this position until polishing steps are completed in all the polishing stations P1–4.

Figure 4F:
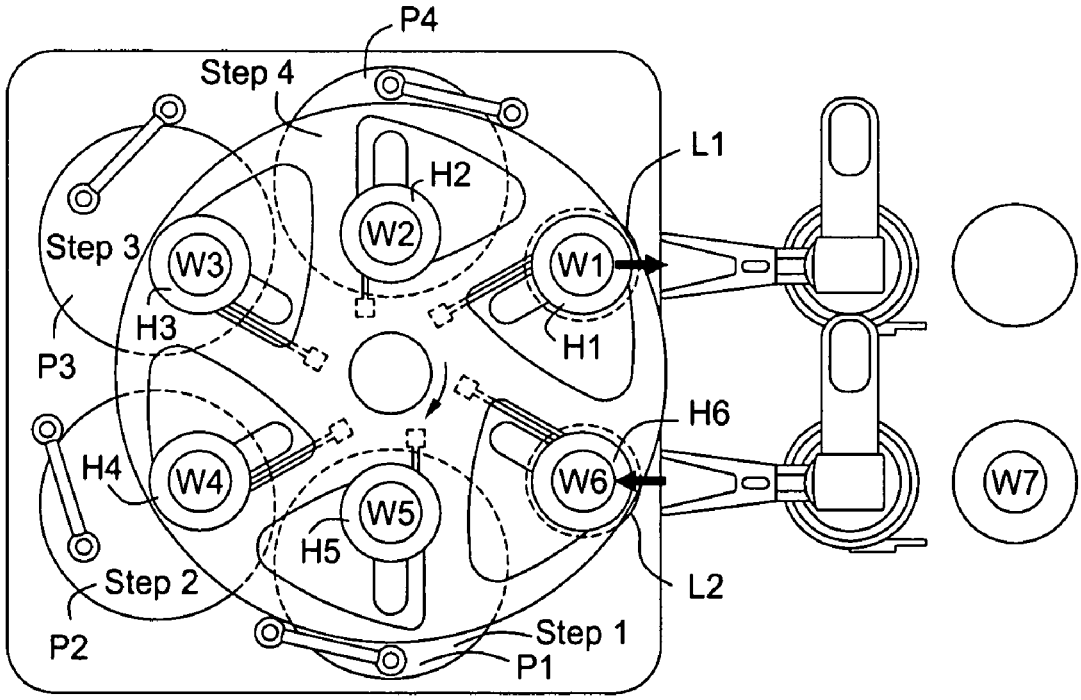

FIG. 4F illustrates that, after completing the polishing process shown in FIG. 4E, the carousel 110 rotates another 60° clockwise so that the head systems H2, H3, H4, and H5 may be aligned with the polishing stations P4, P3, P2 and P1 respectively. When the head systems and the polishing stations are aligned, processing may be conducted in the polishing stations P1–4 simultaneously, wherein polishing step 1 is performed in the polishing station P1 to substrate W5, polishing step 2 is performed in the polishing station P2 to substrate W4, polishing step 3 is performed in the polishing station P3 to substrate W3, and polishing step 4 is performed in the polishing station P4 to substrate W2. While polishing process is in process in the polishing stations P14, the head systems H6 and H1 are aligned with the load cups L1 and L2 respectively so that substrate W6 is loaded on the head system H6, and substrate W1 is unloaded from the head system H1. Generally, the carousel 110 remains in this position until polishing steps are completed in the both polishing stations P1–4.

Figure 4G:
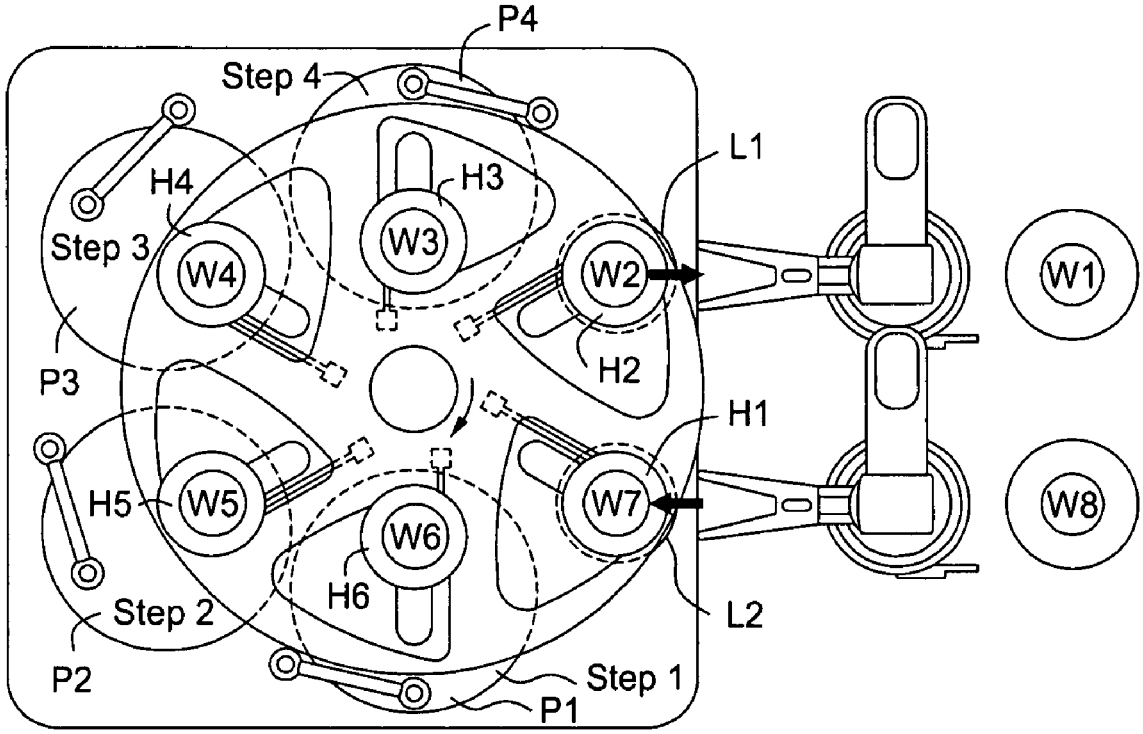

FIG. 4G illustrates that, after completing the polishing process shown in FIG. 4F, the carousel 110 rotates another 60° clockwise so that the head systems H3, H4, H5, and H6 may be aligned with the polishing stations P4, P3, P2 and P1 respectively. When the head systems and the polishing stations are aligned, processing may be conducted in the polishing stations P1–4 simultaneously, wherein polishing step 1 is performed in the polishing station P1 to substrate W6, polishing step 2 is performed in the polishing station P2 to substrate W5, polishing step 3 is performed in the polishing station P3 to substrate W4, and polishing step 4 is performed in the polishing station P4 to substrate W3. While polishing process is in process in the polishing stations P1–4, the head systems H1 and H2 are aligned with the load cups L1 and L2 respectively so that substrate W7 is loaded on the head system H1, and substrate W2 is unloaded from the head system H2. And this step may be repeated.

As shown in FIGS. 4A–G, the time to process one substrate for a four step polishing process equals the time of the longest step among polishing steps 1–4, unloading a substrate, and loading a substrate.

FIGS. 5A–G illustrate an exemplary sequence of a batch polishing process using the polishing system 100 of FIG. 1.

In one embodiment, the polishing stations P1, P2, P3 and P4 are configured to perform the same polishing step. Both load cups L1 and L2 are configured to load unprocessed substrates and unload processed substrates. The carousel 110 is illustrated to rotate clockwise. However, the carousel 110 may also rotate counter clockwise to achieve the same result with proper variations in the sequencing and step arrangement.

Figure 5A:
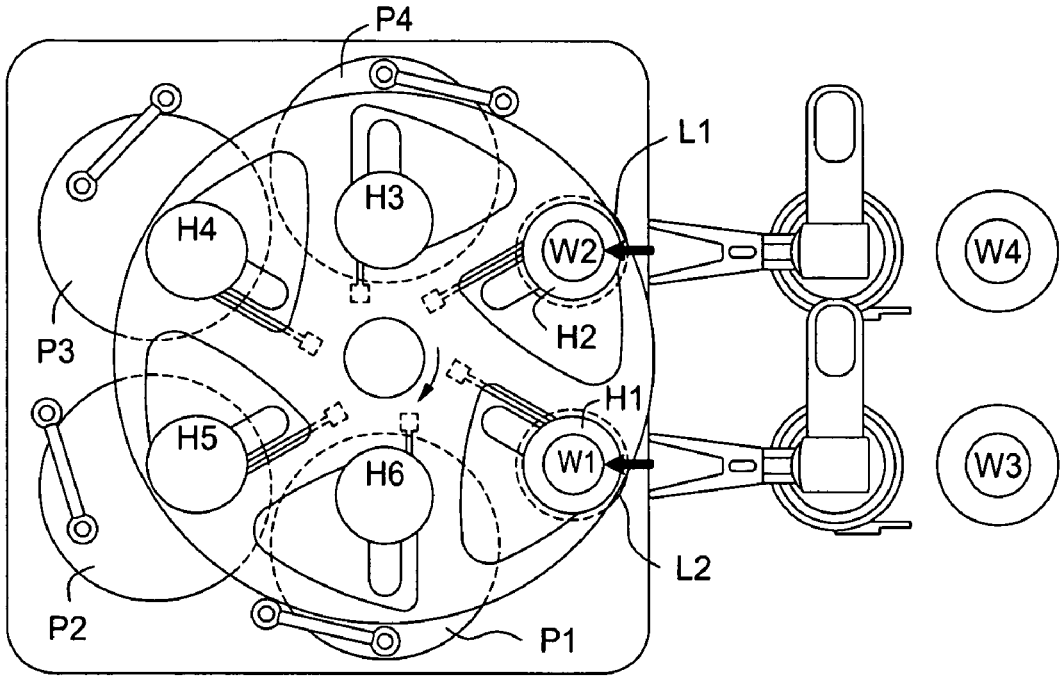
FIGS. 5A–5G illustrate an exemplary sequence of a polishing process using the polishing system of FIG. 1.

FIG. 5A illustrates that the polishing system 100 in its initial status, wherein the polishing heads H3–H6 are empty, the polishing stations P1–P4 are idle. Unprocessed substrates W1 and W2 are loaded onto the head systems H1 and H2 respectively.

Figure 5B:
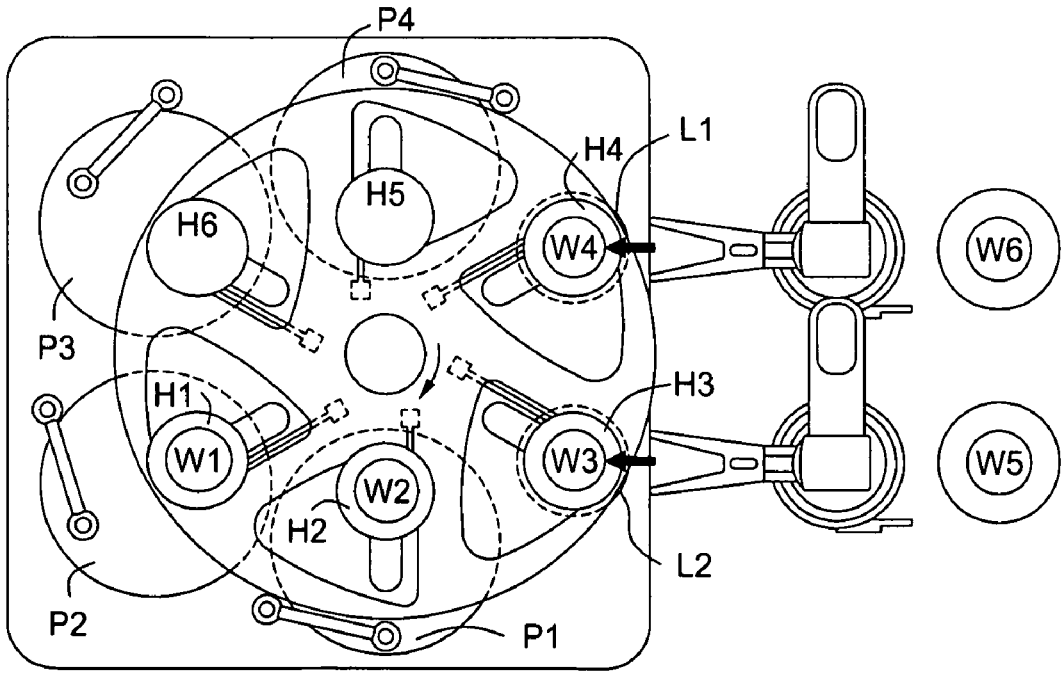

FIG. 5B illustrates that the carousel 110 rotates 120° clockwise so that the head systems H3 and H4 may be aligned with the load cups L1 and L2 respectively and unprocessed substrates W3 and W4 are loaded onto the head systems H3 and H4 respectively.

Figure 5C:
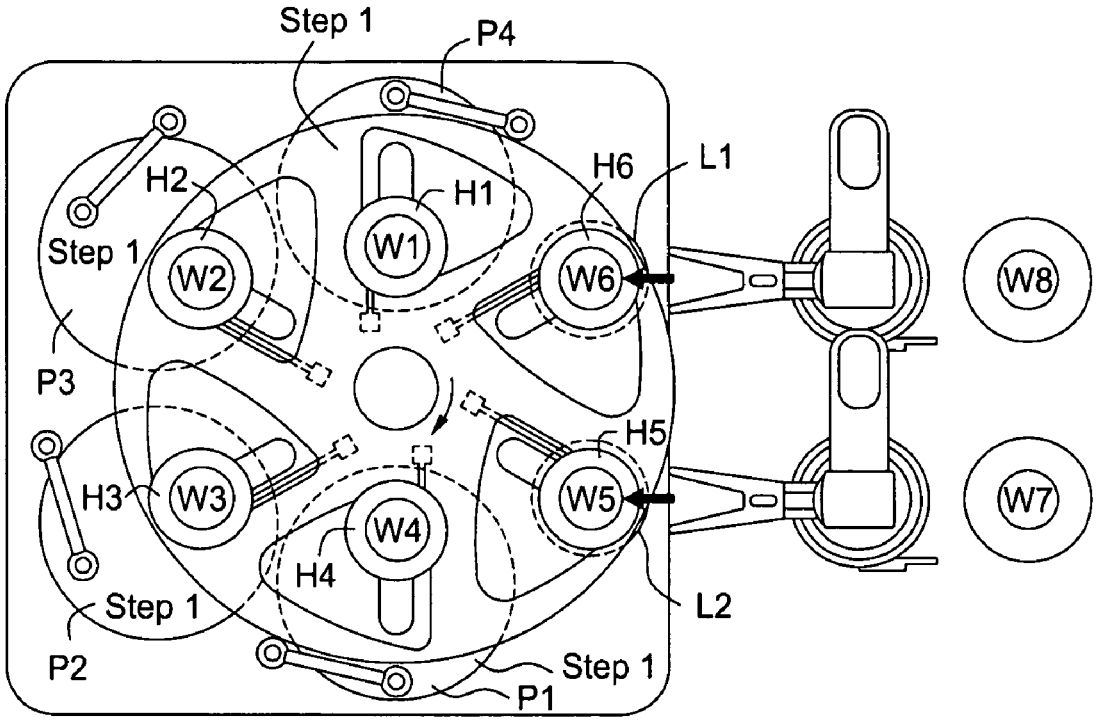

FIG. 5C illustrates, after the head systems H3 and H4 are loaded, the carousel 110 rotates 120° clockwise again so that the head systems H1, H2, H3 and H4 may be aligned with the polishing stations P4, P3, P2 and P1 respectively. When the head systems and the polishing stations are aligned, processing may be conducted in all four polishing stations P1–4 simultaneously to substrates W4, W3, W2 and W1. While polishing process is in progress in the polishing stations P1–4, the head system H5 and H6 are aligned with the load cups L1 and L2 respectively and substrates W5 and W6 are loaded on the head system H5 and H6 respectively. Generally, the carousel 110 remains in this position until polishing process is completed in all the polishing stations P1–4.

Figure 5D:
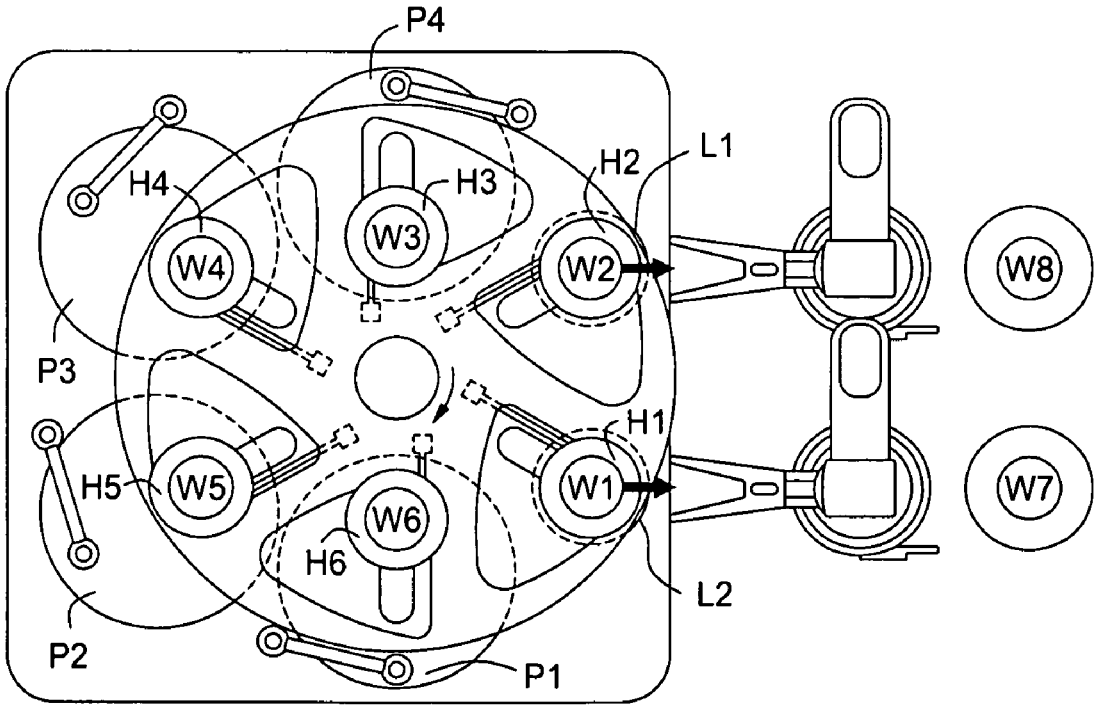

FIG. 5D illustrates that the carousel 110 has rotates another 120° clockwise from the position shown in FIG. 5C. The head system H1 and H2 are aligned with the load cups L1 and L2 respectively. Substrates W1 and W2 are then unloaded from the head system H1 and H2 to the load cups L1 and L2. Substrates W1–2 are then unloaded from the load cups L1–2 to cassettes and unprocessed substrates W7 and W8 are loaded to the head system H1 and H2 respectively, as shown in FIG. 5E.

Figure 5E:
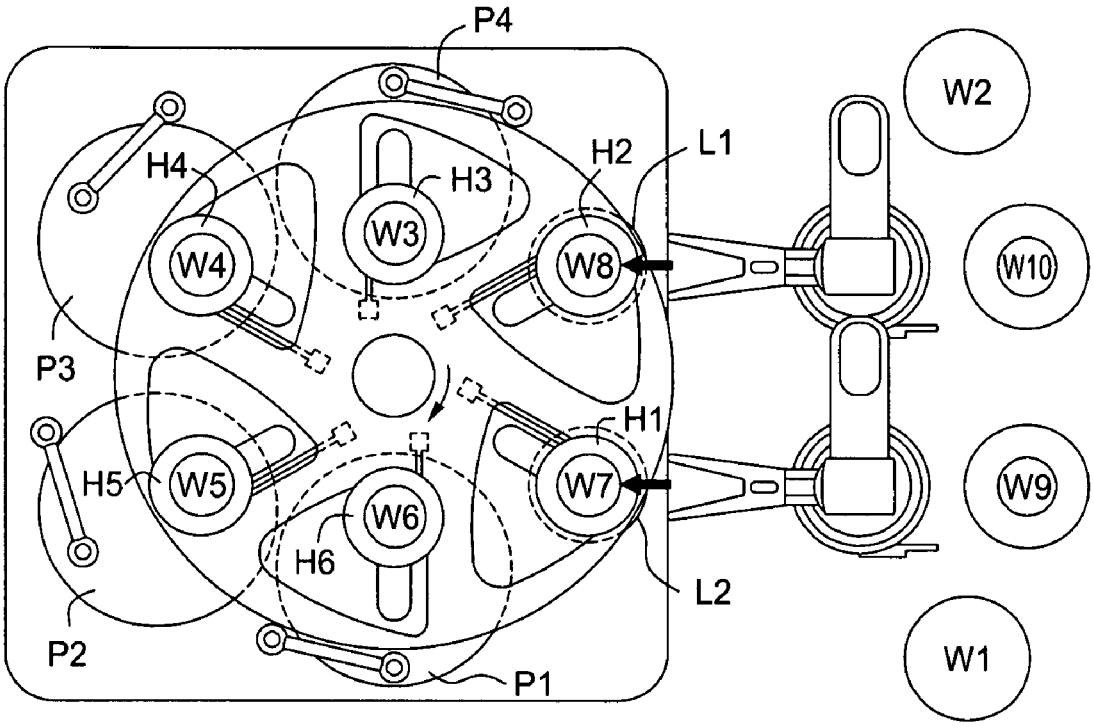
Figure 5F:
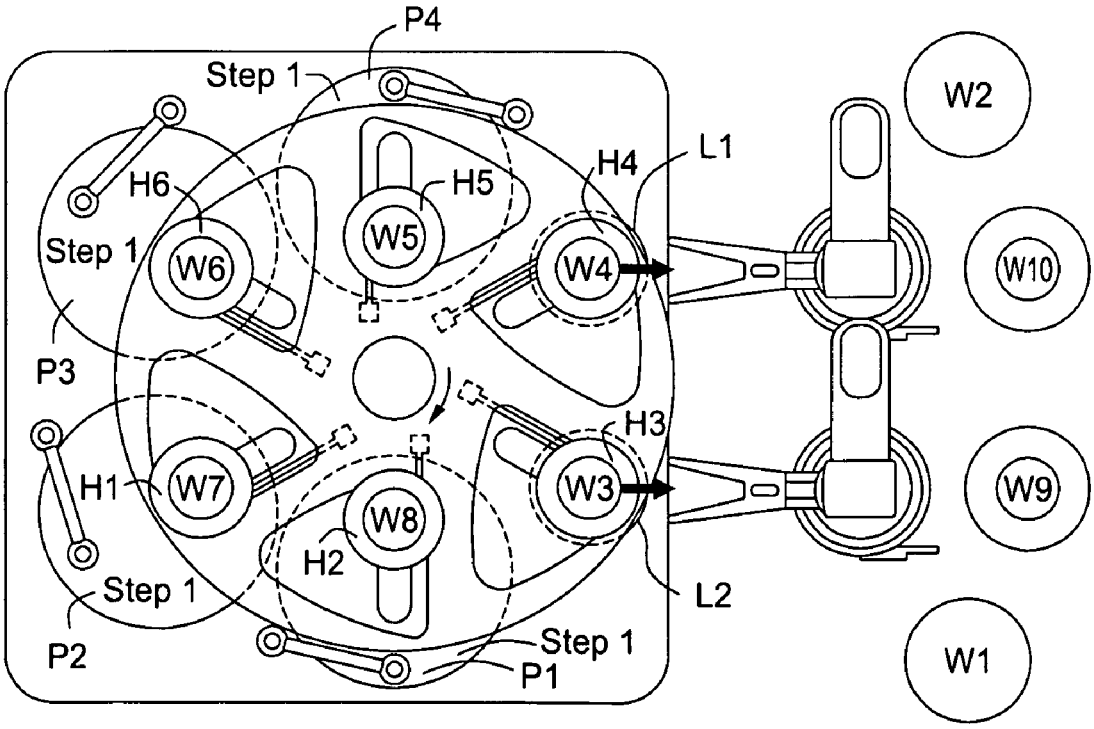
Figure 5G:
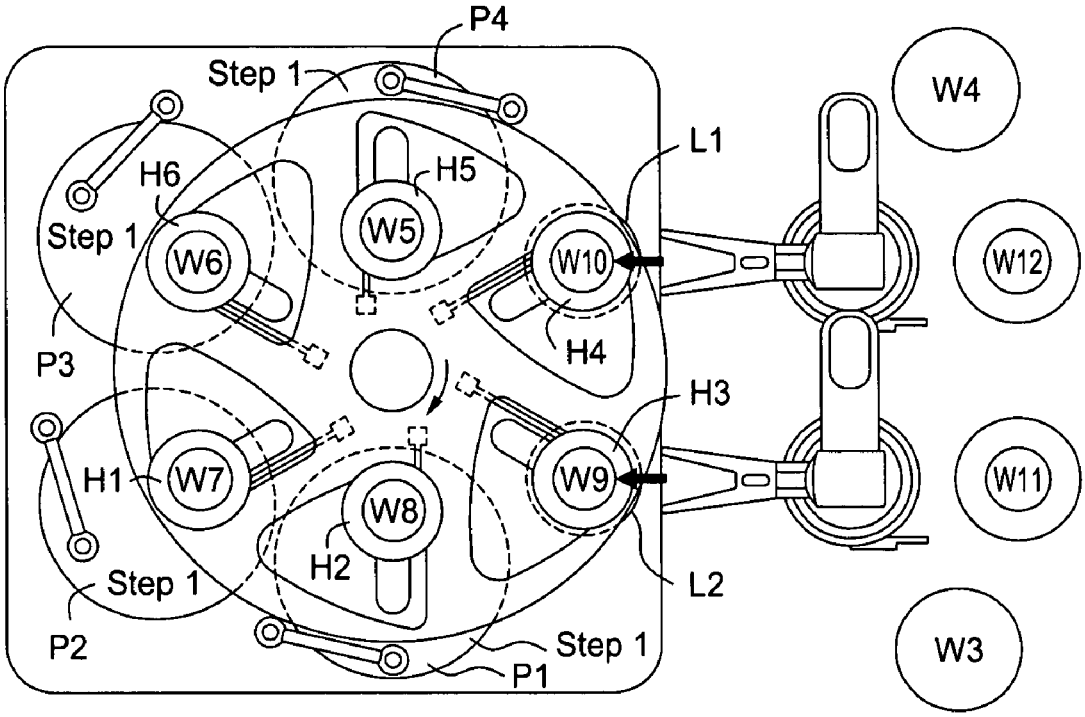

FIG. 5F illustrates that the carousel 110 rotates another 120° clockwise from the position shown in FIGS. 5D–E so that the head systems H5, H6, H1 and H2 may be aligned with the polishing stations P4, P3, P2 and P1 respectively. In this position, polishing process is conducted in all four polishing stations P1–4 simultaneously. Substrates W3–4 are unloaded and new substrates W9–10 are loaded and waiting in queue to be processed, as shown in FIG. 5G. To this point, the processing sequence is established and the process of FIGS. 5F–G may be repeated.

As shown in FIGS. 5F–G, the time to process four substrates for one step batch polishing process equals the polishing time plus the time of unloading processed substrate and loading unprocessed substrate.

It should be noted that although only polishing systems with a six headed carousel, four polishing stations and two load cups is illustrated in the Figures, a person skilled in the art may also derive polishing system with other configurations to have similar advantages. For example, a polishing system having a nine headed carousel, six polishing stations and three load cups, and centers of the six polishing stations and three load cups form a non perfect polygon.

While the foregoing is directed to embodiments of the present invention, other and further embodiments of the invention may be devised without departing from the basic scope thereof, and the scope thereof is determined by the claims that follow.

What is claimed is:

1. An apparatus for polishing a substrate, comprising:
a base;
four polishing stations disposed on the base;
two load cups disposed on the base; and
a carousel supported by the base, wherein the carousel comprises six substrate heads and is rotatable about a carousel axis, and each of the six substrate heads is configured to align with any one of the four polishing stations and the two load cups.

2. The apparatus of claim 1, wherein the six substrate heads are mounted on a carousel base at equal angular intervals about the carousel axis.

3. The apparatus of claim 1, wherein the six substrate heads are identical.

4. The apparatus of claim 1, wherein each of the six substrate heads is independently operable.

5. The apparatus of claim 1, wherein when any one of the six substrate heads is aligned with one of the polishing stations or the load cups, the remaining substrate heads are alignable with one of the remaining polishing stations and load cups.

6. The apparatus of claim 1, wherein each of the substrate heads has a radial movement relative to the carousel axis.

7. The apparatus of claim 6, wherein the radial movement provides a sweeping motion during polishing.

8. The apparatus of claim 6, wherein the radial movement is achieved using a lead screw driven by a sweeping motor.

9. The apparatus of claim 1, wherein centers of the four polishing stations and the two load cups form a hexagon and the two load cups are immediately next to each other in the hexagon.

10. The apparatus of claim 9, wherein the hexagon is non symmetric.

11. The apparatus of claim 9, wherein the six substrate heads are mounted on the carousel at equal angular intervals about the carousel axis and each of the six substrate heads moves radially to align with each of the polishing stations and load cups.

12. A polishing system, comprising:
a base;
four polishing stations disposed on the base;
two load cups disposed on the base; and
a carousel supported by the base and rotatable about a carousel axis, the carousel comprising:
a carousel base; and
six substrate heads mounted on the carousel base at equal angular intervals about the axis, wherein each of the substrate heads is rotatable about its own center and radially movable relative to the carousel axis, and each of the substrate heads is configured to support and transfer a substrate among the four polishing stations and two load cups.

13. The polishing system of claim 12, wherein each of the substrate heads aligns with each of the four polishing stations and the two load cups using a combination of radial movement and rotational movement of the carousel.

14. The polishing system of claim 13, wherein centers of the four polishing stations and the two load cups form a non perfect polygon.

15. The polishing system of claim 12, wherein each of the six substrate heads comprises a sweep motor configured to move the respective substrate head radially relative to the carousel axis.

16. A method for polishing a substrate, comprising:
providing a polishing system having at least six substrate heads mounted on a carousel;
loading a first substrate on a first substrate head of the at least six substrate heads by aligning the first substrate head with a first load cup;
aligning the first substrate head with a first polishing station; and
polishing the first substrate in the first polishing station.

17. The method of claim 16, wherein aligning the first substrate head comprises:
rotating the carousel; and
moving the first substrate head radially.

18. The method of claim 16, further comprising:
upon finishing polishing the first substrate in the first polishing station, rotating the carousel;
moving the first substrate head radially to align with a second polishing station; and
polishing the first substrate in the second polishing station.

19. The method of claim 16, wherein polishing the substrate in the first polishing station comprises sweeping the first substrate head radially.

20. The method of claim 16, further comprising:
while loading the first substrate on the first substrate head, simultaneously loading a second substrate on a second substrate head of the at least six substrate heads by aligning the second substrate head with a second load cup;
while aligning the second substrate head with a first polishing station, simultaneously aligning the first substrate head with a second polishing station; and
while polishing the first substrate in the second polishing station, simultaneously polishing the second substrate in the first polishing station.

* * * * *